United States Patent [19]

Arnold

[11] Patent Number: 4,939,343

[45] Date of Patent: Jul. 3, 1990

[54] STEAM GENERATOR FOR STEAM BATHS

[76] Inventor: Josef B. Arnold, Altegghalde 2, CH-6045 Meggen, Switzerland

[21] Appl. No.: 250,704

[22] Filed: Sep. 28, 1988

[30] Foreign Application Priority Data

Oct. 1, 1987 [CH] Switzerland ..... 03831/87

[51] Int. Cl.[5] ..... F22B 1/28

[52] U.S. Cl. ..... 219/276; 219/362; 219/273

[58] Field of Search ..... 219/271–276, 219/333, 362; 261/124, 142; 4/524, 526

[56] References Cited

U.S. PATENT DOCUMENTS

| | | | |
|---|---|---|---|
| 1,601,258 | 9/1926 | Pajer | 219/275 |
| 2,512,892 | 6/1950 | Forsberg | 219/276 |
| 3,337,715 | 8/1967 | Finn | 4/524 |
| 3,806,122 | 4/1974 | Valenta | 261/142 |
| 3,809,374 | 5/1974 | Schossow | 261/142 |
| 3,864,440 | 2/1975 | Giocoechea | 261/122 |
| 3,982,095 | 9/1976 | Robinson | 219/275 |
| 4,112,281 | 9/1978 | Epps | 219/283 |
| 4,399,349 | 8/1983 | Deming | 219/276 |
| 4,566,450 | 1/1986 | Brossman, Jr. | 128/200.11 |

FOREIGN PATENT DOCUMENTS

| | | |
|---|---|---|
| 3404892 | 8/1985 | Fed. Rep. of Germany . |
| 3705715 | 9/1987 | Fed. Rep. of Germany . |
| 598814 | 5/1978 | Switzerland . |
| 636263 | 5/1983 | Switzerland . |

*Primary Examiner*—Teresa J. Walberg
*Attorney, Agent, or Firm*—Darby & Darby

[57] ABSTRACT

A steam generator (1) for steam baths, in particular steam cubicles, is proposed, where a column-shaped housing (2) has an electrically heatable water bath (3) acted upon by air in operation, so that the air surrounding the housing (2) is sucked through a ventilator (4) into the housing (2) and recirculated through the housing (2) and through the water bath (3).

13 Claims, 2 Drawing Sheets

STEAM GENERATOR FOR STEAM BATHS

The present invention relates to a steam generator for steam baths, in particular steam cubicles.

A known steam generator for steam cubicles, as described in the literature in CH-636,263, 636,264 and 630,522, heats the evaporation liquid over an evaporation surface in the region of the cubicle floor. Here, the evaporation liquid is recirculated by means of a circulation pump between the collection container and the evaporation surface, and, if required, an additive container is also included in the circuit. The disadvantage of this system is that it requires a system-specific cubicle construction. Thus, this apparatus cannot be used either to combine simple, commercially available shower cubicles or to add to existing cubicles. For this reason, the system has too complicated a construction. Furthermore, it takes too long for the evaporation liquid to be brought to the boil, since after all the entire contents of the tank must be heated up. The system can thus be described as slow. The additive container intended for mixing in is susceptible to deposits and must be cleaned from time to time. A further disadvantage of this additive container is that it cannot be emptied with the means available. Thus, the problem is that the residues are used as a nutrient medium by bacteria, especially when the steam cubicle is not operated for a few days or the additive container is not included in operation. It remains unanswered whether this disadvantage is really avoided in operation by the action of high temperatures and the destruction of the bacteria, since the danger of disadvantageous effects is only reliably eliminated when there are no grounds at all for it.

The present invention is intended to overcome these disadvantages. According to the invention, this object is achieved in accordance with the features of the claims. The advantages of the invention are the compact and thus inexpensive construction, the universal applicability for cubicles of all types, the promptness with which it is ready for operation and the complete hygiene without action by the user, and, last but not least, the compulsory circulation of the entire content of the steam cubicle, that is to say of the air-steam mixture.

Figure 1A:
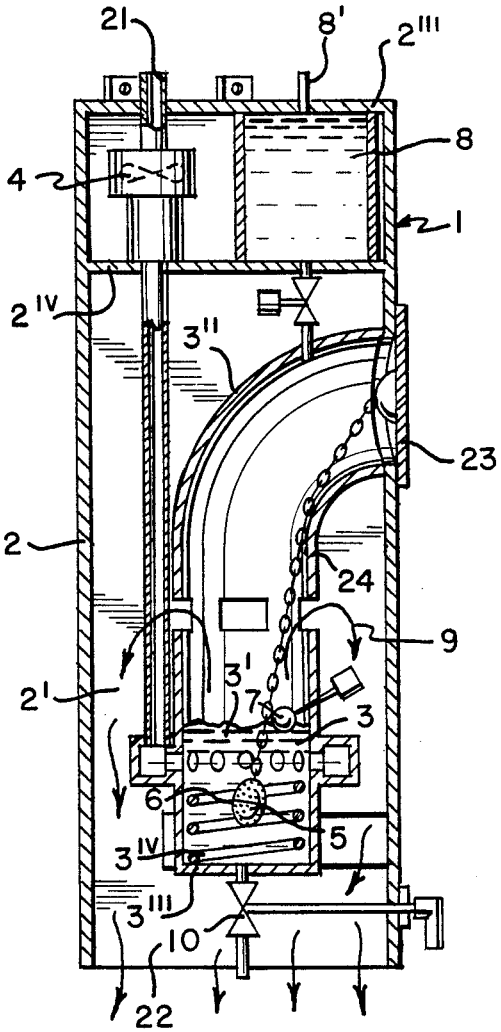
Figure 1B:
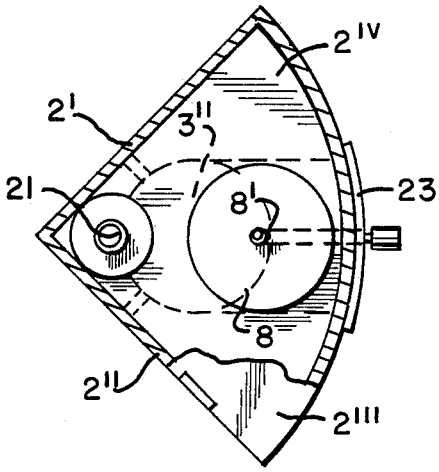
Figure 2:
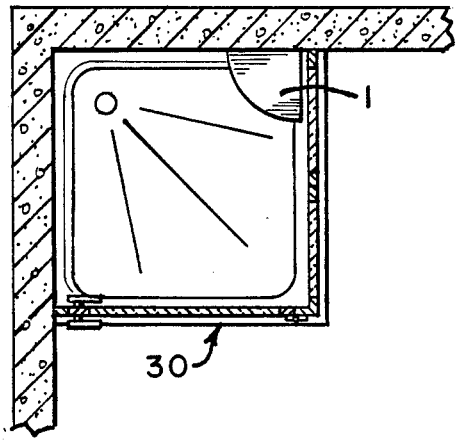
Figure 3:
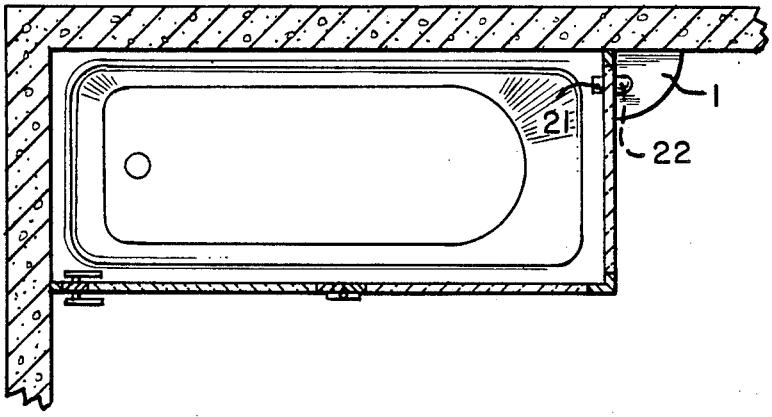

The invention is explained in greater detail with reference to the figures, in which:

FIGS. 1A and 1B shows sections through the steam generator, for the use of the steam generator in a cubicle, FIG. 2 shows the use of the steam generator in a shower cubicle, and FIG. 3 shows the use of the steam generator in a bath cubicle.

The steam generator 1 shown in FIGS. 1A and 1B has a column-shaped housing 2 of triangular cross section having two side walls $2^{I}$ and $2^{II}$ standing perpendicular to one another. Here, a roof $2^{III}$ closes the housing 2 to the top, so that the housing 2 has at its top end only two openings, the inlet opening 21 for the surrounding air and a filling nozzle $8^{I}$ for filling up the water tank 8, which is arranged between the roof $2^{III}$ and an intermediate partition $2^{IV}$. In this intermediate space there is also located the ventilator 4 and the electrical apparatus (not shown), such as fuses, main switch, distribution terminals and, where appropriate, a time switch and temperature measurement device. Below the intermediate partition $2^{IV}$, the water bath 3 is accommodated in a pipe-shaped tube $3^{II}$. This tube $3^{II}$ here enables the additive container 6 to be received through its opening ending in the housing 2. This opening is closed in operation by the cover 23, whereby the additive container 6 is attached to it by a chain 24 such that the additive container 6 dips into the water bath 3. In order that the tube $3^{II}$ can contain the water bath 3, it is provided with a floor $3^{III}$. Emptying of the water bath 3 is provided for by a drain cock 10 which can be operated from outside. This procedure can also be automated, for example if the drain cock 10 is constructed as a solenoid valve which is opened by a time clock or the main switch when the device is switched off.

The heating $3^{IV}$, which is arranged in the water bath 3 in the form of a wound resistance heater, is part of the function of the steam generator. The size of the water bath 3 is kept small in order that the quantity of the water bath 3 is brought close to the boiling point by the heating $3^{IV}$ as quickly as possible. The air supplied through the ventilator 4 is advantageously introduced through an annular channel at the periphery of the water bath 3 or the surrounding tube $3^{II}$ respectively. The aeration of the water bath 3 by the air supply increases the contact surfaces and intensifies the saturation of the air. The circulation of the air improves the temperature distribution of the steam cubicle, as opposed to the flow of simple convection. Moreover, the circulation returns the water which has become steam into the water bath 3. Thus, the present steam generator 1 operates as a closed circuit, as opposed to the open system of the state of the art. Since the use of additives 5 is an optional measure, the water bath 3 has deliberately been called a water bath and not a liquid bath. The atmosphere of the cubicle is referred to as air, whereby the saturation and supersaturation of the air can naturally also be called steam or steam-air mixtures.

The possibilities of arranging the steam generator are shown by FIGS. 2 and 3. Here, the steam generator 1 shown in FIG. 1 is shown inside a shower cubicle 30. If for any reason the installation of the steam generator 1 is desired to be outside the cubicle, then the air inlet 21 and the outlet opening 22 each have added to them an angled channel piece such that a direct connection is formed between the cubicle wall and the steam generator 1. An advantage of this arrangement is that all the electrical installations are located outside the cubicle, and thus the risks of the electric current are additionally reduced for the bath user. It is understood that steam generators of uniform size in accordance with the invention are suitable as modular units for the equipping of steam cubicles or steam baths of any size. Thus, thanks to the invention, a sauna of Finnish design can be converted or added to to give a "Turkish bath", for example, without difficulty.

I claim:

1. A steam generator for steam baths, comprising:

a column-shaped housing;

a ventilator sucking air into said housing;

a water bath within said housing, said bath being partially filled with water, said ventilator forcing air through said water in said water bath;

means for heating said water bath, steam emerging from said water bath flows around said water bath before emerging from said housing.

2. A steam generator for steam baths as in claim 1, and further comprising means for providing additives to said water bath.

3. A steam generator for steam baths as in claim 2, wherein said means for providing additives to said water bath include a permeable additive container.

4. A steam generator for steam baths as in claim 1, further comprising a level regulator for monitoring the water level in said water bath, and means to maintain said water level.

5. A steam generator for steam baths as claimed in claim 4, and further comprising a water supply tank positioned in a container over said water bath to allow gravity feed of makeup water.

6. A steam generator for steam baths as in claim 1, further comprising a water supply tank positioned in a container over said water bath to allow gravity feed of makeup water.

7. A steam generator for steam baths as claimed in claim 1, wherein said column-shaped housing is vertical and has two perpendicular sides for nesting in corners.

8. A steam generator for steam baths as claimed in claim 7, wherein said housing includes walls, said walls contain means for fastening to another wall.

9. A steam generator for steam baths as claimed in claim 1, wherein said housing includes walls and said walls contain means for fastening to another wall.

10. A steam generator for steam baths as claimed in claim 1, wherein said housing includes walls, said walls having inlet openings for air and an outlet opening for an air-steam mixture leaving said generator.

11. A steam generator for steam baths as claimed in claim 1, wherein said water bath is equipped with a drain cock.

12. A steam generator for steam baths, comprising:

a column-shaped housing;

a water bath within said housing, said bath being partially filled with water;

a ventilator for sucking air into said housing, said ventilator forcing air through said water in said water bath;

means for heating said water bath, said water bath having exit means for air passage such that air leaving said water bath makes substantially a 180° bend prior to discharge from said housing.

13. A steam generator for steam baths comprising;

a column-shaped housing having a open portion near the bottom thereof;

a ventilator having an inlet side for drawing in air, and an air discharge side;

a water bath within said housing, said ventilator discharge side being connected to said bath and pushing air into said water bath at a location below the water level therein, said air bubbling through and agitating said water;

means for heating said water bath, said means for heating being sized to bring the water in said bath near the water boiling temperature, in operation, a hot air-steam mixture leaving said water bath and exiting said generator through said open portion of said housing.

* * * * *